US005181358A

United States Patent [19]

Mead

[11] Patent Number: 5,181,358

[45] Date of Patent: Jan. 26, 1993

[54] SIMULATION LOG SIDING APPARATUS

[76] Inventor: Gerald R. Mead, P.O. Box 394, Teague, Tex. 75860

[21] Appl. No.: 783,521

[22] Filed: Oct. 28, 1991

[51] Int. Cl.[5] ..... E04B 1/10; E04C 3/00; E04C 3/30; B44F 7/00

[52] U.S. Cl. ..... 52/233; 52/580; 52/313; 52/593

[58] Field of Search ..... 52/233, 580, 313, 593

[56] References Cited

U.S. PATENT DOCUMENTS

| | | | |
|---|---|---|---|
| 2,250,764 | 7/1941 | Hoess | 52/313 |
| 4,288,954 | 9/1981 | O'Donnell | 52/233 |
| 4,433,519 | 2/1984 | Jenkins | 52/233 |

*Primary Examiner*—Richard E. Chilcot, Jr.
*Assistant Examiner*—Beth A. Aubrey
*Attorney, Agent, or Firm*—Leon Gilden

[57] ABSTRACT

Convex log simulation longitudinal members are arranged in an adjacent contiguous interlocking relationship relative to one another for securement coextensive with an exterior surface of a structural vertical wall surface to simulate log construction. The appparatus includes interlocking flanges arranged coextensively relative to adjacent edges of the longitudinal members utilizing securement flanges as required to enhance mounting and securement of each longitudinal member relative to the vertical wall surface.

1 Claim, 5 Drawing Sheets

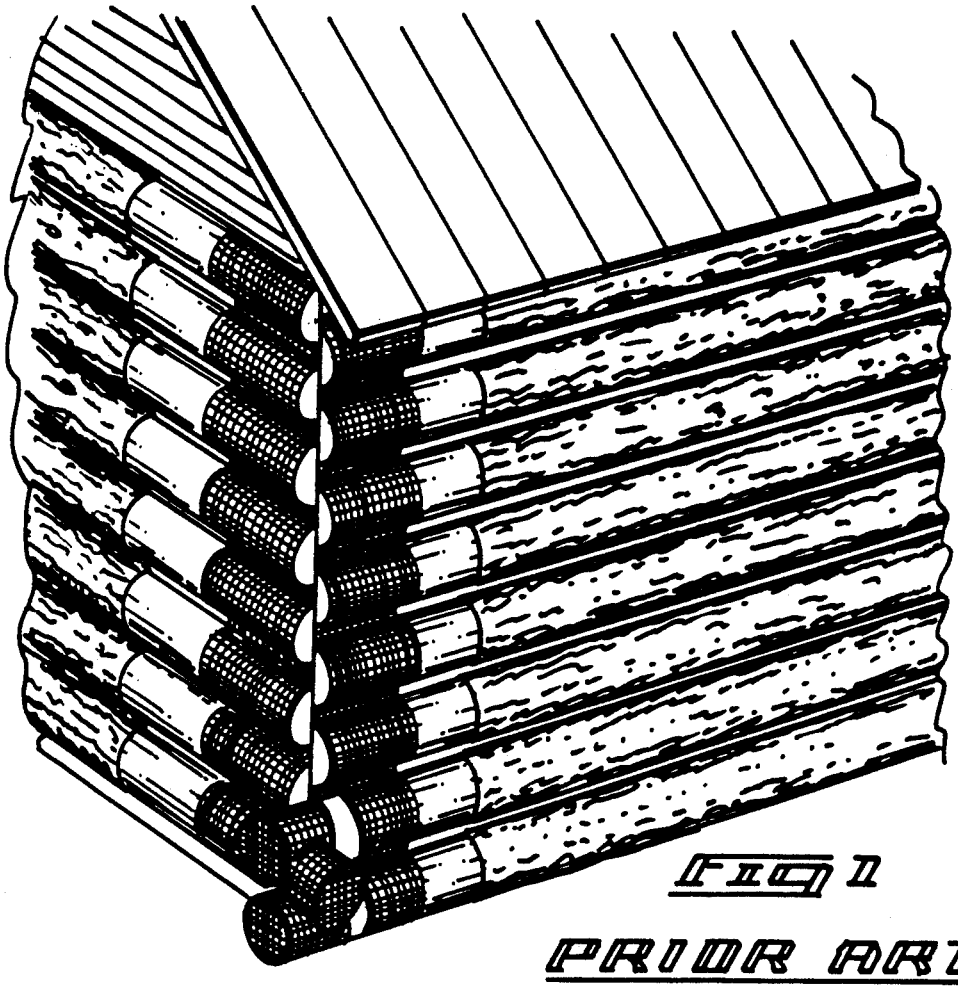
FIG 1
PRIOR ART
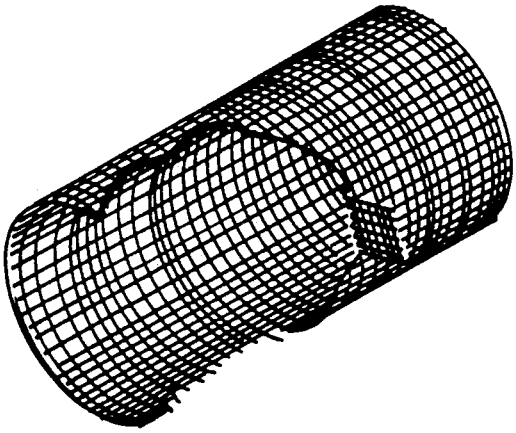
FIG 2
PRIOR ART
FIG 3
PRIOR ART
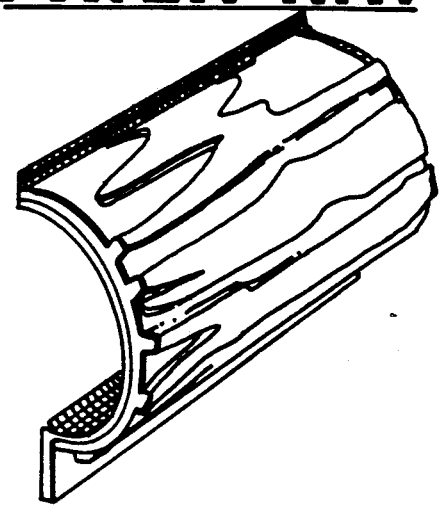

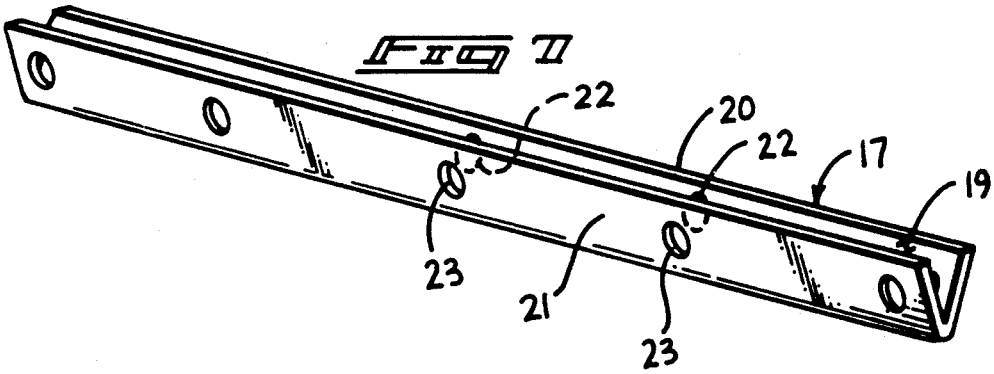
Fig 7
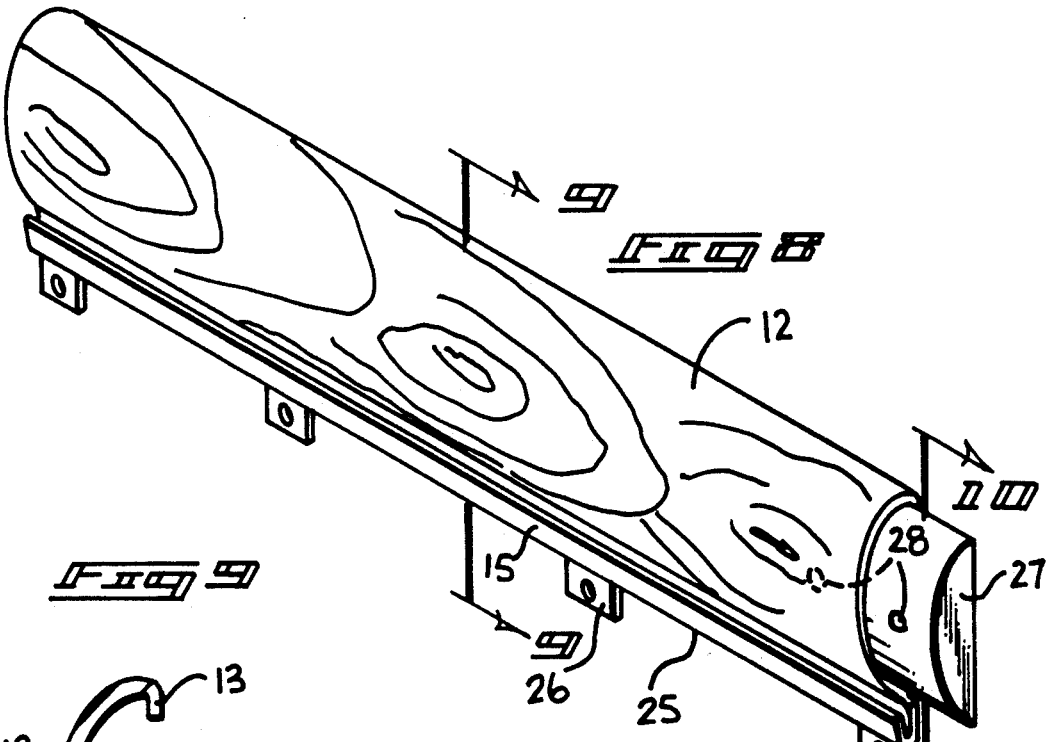
Fig 8
Fig 9
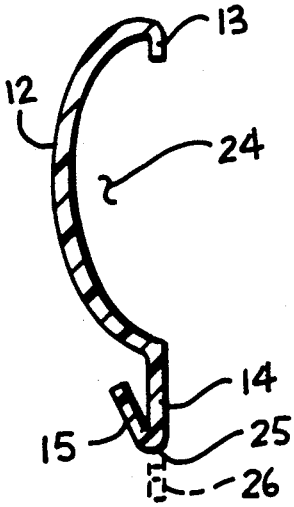
Fig 10
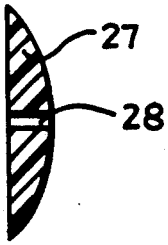

SIMULATION LOG SIDING APPARATUS

BACKGROUND OF THE INVENTION

1. Field of the Invention

The field of invention relates to structural components, and more particularly pertains to a new and improved simulation log siding apparatus wherein the same is arranged to effect simulation of a log wall construction.

2. Description of the Prior Art

Contemporary appeal of log wall houses and their utilization in various environments has developed into a condition where available logs are frequently in short supply, as well as attendant costs and time required in such construction techniques. Further, the retrofit of such log wall structure to an existing dwelling is frequently difficult and time consuming.

The instant invention attempts to overcome deficiencies of the prior art by providing a log wall simulation organization that addresses the covering of existing wall structure to simulate a log siding apparatus. Prior art simulation log siding structure is illustrated in U.S. Pat. No. 4,288,954 to O'Donnell wherein a wire metal lath is shaped to a semi-circular configuration and mounted to a structural wall utilizing a cement-plaster layer to overlie the associated metal lath for simulation of log structure.

U.S. Pat. No. 3,815,308 to Corey sets forth planar wall members to overlie an existing vertical wall surface utilizing an underlying metal lath mounting the wall structure.

U.S. Pat. No. 4,305,238 to Harward, et al. sets forth a simulated log siding formed of two cooperating and mounted semi-circular imitation log components.

As such, it may be appreciated that there continues to be a need for a new and improved simulation log siding apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of log siding apparatus now present in the prior art, the present invention provides a simulation log siding apparatus wherein the same is arranged to provide for interlocking longitudinal log siding members to overlie a vertical wall surface. As such, the general purpose of the present invention, which will be described subsequently in greater detail, is to provide a new and improved simulation log siding apparatus which has all the advantages of the prior art log siding apparatus and none of the disadvantages.

To attain this, the present invention provides convex log simulation longitudinal members arranged in an adjacent contiguous interlocking relationship relative to one another for securement coextensive with an exterior surface of a structural vertical wall surface to simulate log construction. The apparatus includes interlocking flanges arranged coextensively relative to adjacent edges of the longitudinal members utilizing securement flanges as required to enhance mounting and securement of each longitudinal member relative to the vertical wall surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved simulation log siding apparatus which has all the advantages of the prior art log siding apparatus and none of the disadvantages.

It is another object of the present invention to provide a new and improved simulation log siding apparatus which may be easily and efficiently manufactured and marketed.

It is a further object of the present invention to provide a new and improved simulation log siding apparatus which is of a durable and reliable construction.

An even further object of the present invention is to provide a new and improved simulation log siding apparatus which is susceptible of a low cost of manufacture with regard to both materials and labor, and which accordingly is then susceptible of low prices of sale to the consuming public, thereby making such simulation log siding apparatus economically available to the buying public.

Still yet another object of the present invention is to provide a new and improved simulation log siding apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art log siding simulation construction.

FIG. 2 is an isometric illustration of the metal lath utilized by the prior art, as illustrated in FIG. 1.

FIG. 3 is an isometric illustration of the layered construction of the prior art structure, as set forth in FIG. 1.

FIG. 7 is an isometric illustration of a starter strip utilized by the instant invention.

FIG. 8 is an isometric illustration of a modified longitudinal construction member utilized by the invention.

FIG. 9 is an orthographic view, taken along the lines 9—9 of FIG. 8 in the direction indicated by the arrows.

FIG. 10 is an orthographic view, taken along the lines 10—10 of FIG. 8 in the direction indicated by the arrows.

DESCRIPTION OF THE PREFERRED EMBODIMENT

Figure 4:
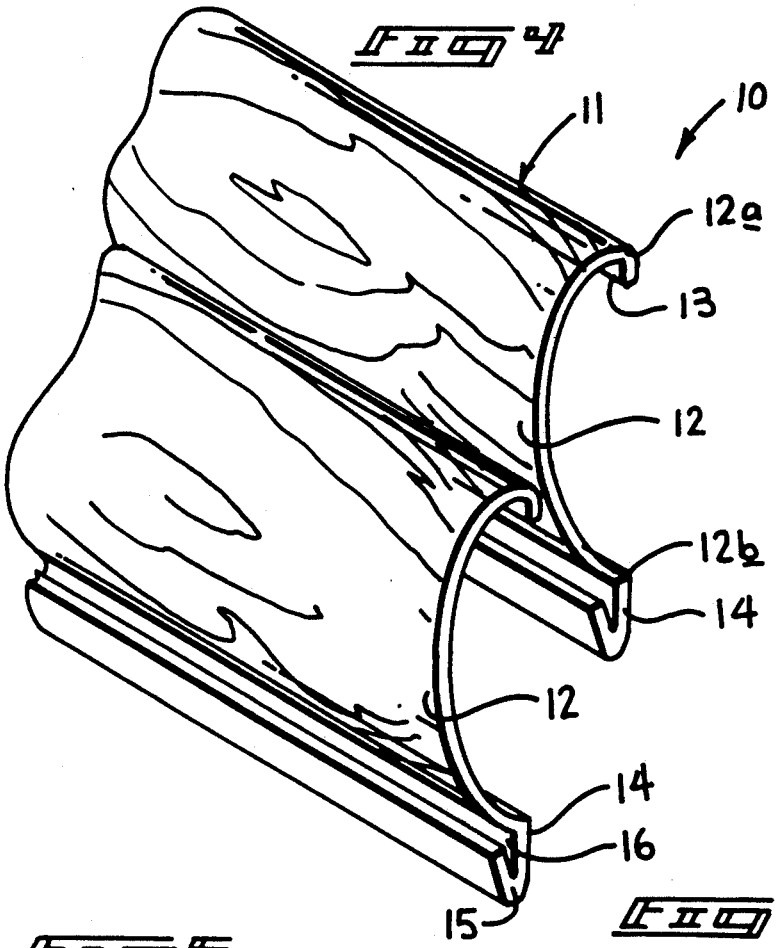
FIG. 4 is an isometric illustration of interlocking longitudinal members utilized by the invention.
Figure 5:
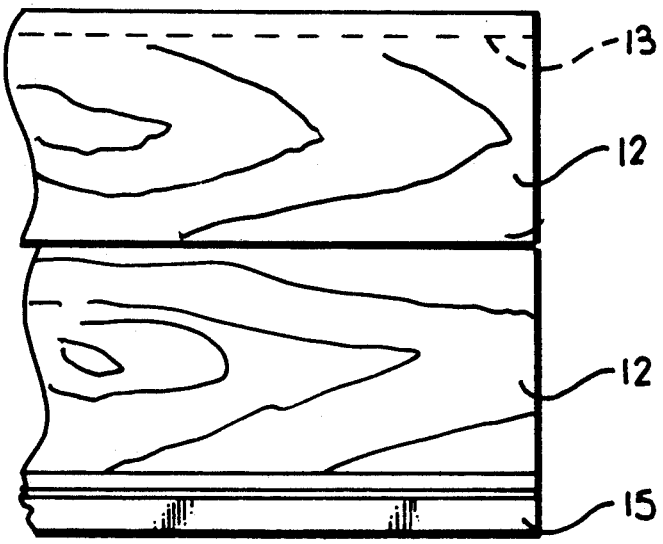
FIG. 5 is an orthographic front view of the members, as illustrated in FIG. 4.

With reference now to the drawings, and in particular to FIGS. 1 to 16 thereof, a new and improved simulation log siding apparatus embodying the principles and concepts of the present invention and generally designated by the reference numeral 10 will be described.

The FIGS. 1-3 illustrate a prior art simulated log siding, as set forth in the U.S. Pat. No. 4,288,954, wherein a metal lath includes a plurality of layers to form semi-circular components secured to a vertical support surface to simulate a log cabin type appearance.

Figure 6:
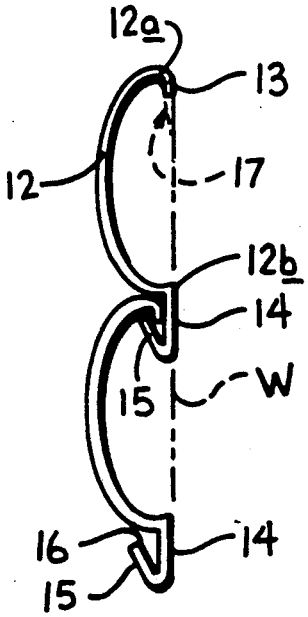
FIG. 6 is an orthographic cross-sectional illustration of the longitudinal members mounted to a vertical wall surface.

More specifically, the simulation log siding apparatus 10 of the instant invention essentially comprises a plurality of longitudinal members 11 arranged in a parallel contiguous interlocking edge-to-edge relationship relative to one another that are arranged and mounted to an associated structural vertical wall support surface "W", such as illustrated in the FIG. 6. Each longitudinal member 11 includes an arcuate convex semi-cylindrical wall 12, including an upper planar flange 13 mounted to a wall upper end 12*a* projecting downwardly and below the upper end 12*a* rearwardly of the semi-cylindrical wall 12. Coplanar therewith is a lower flange 14 projecting below the wall lower edge 12. The upper planar flange 13 and the lower flange 14 are formed along a diameter of each longitudinal member 11, as illustrated. The lower flange 14 includes a lower flange plate 15 projecting upwardly of a lower edge of the lower flange to define a "V" shaped through 16, including an acute included angle between the lower flange plate 15 and the lower flange 14. To initiate mounting of the longitudinal members 11, a starter strip 17 is provided for mounting of an uppermost longitudinal member 11 thereto. The starter strip 17 includes a rear starter plate 20 mounted to a forward starter plate 21 defining an acute angle therebetween and an associated receiving trough 19 to receive the upper planar flange 13 of the uppermost longitudinal member 11, in a manner as illustrated in FIG. 6 for example.

The FIG. 8 illustrates a lower flange junction 25 defined by the intersection of the lower flange 14 and the lower flange plate 15, including a plurality of spaced apertured securement flanges 26 that are coplanar with the lower flange 14 to receive fasteners therethrough for securement to the wall "W" to ensure structural integrity of the longitudinal members 11 mounted to the wall. As illustrated in FIG. 8, a semi-cylindrical connector member 27 defined by a predetermined cross-sectional configuration is substantially equal to that of a predetermined cross-sectional configuration defined by the cavity 24 of the longitudinal member 11. The connector member 27 permits alignment and securement of adjacent longitudinal members 12 that are arranged in an end-to-end relationship. Spaced connector member bores 28 permit projection of fasteners through the semi-cylindrical wall 12 and the connector member 27 for fastening of the longitudinal members 11 to the connector memeber 27.

Figure 11:
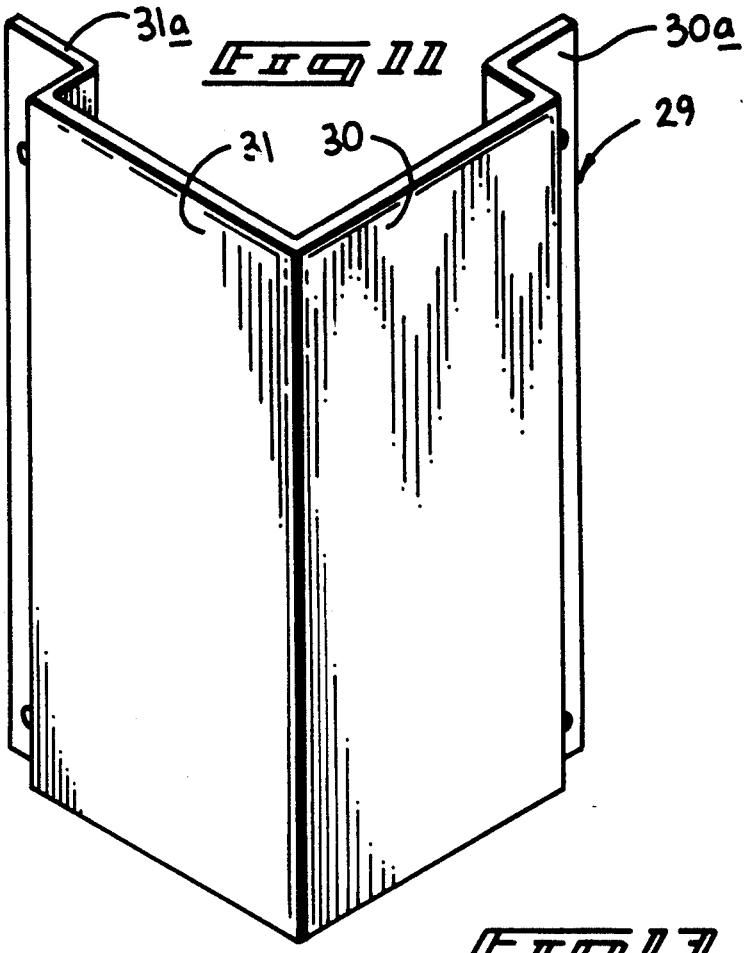
FIG. 11 is an isometric illustration of an outside corner cover member utilized by the invention.
Figure 12:
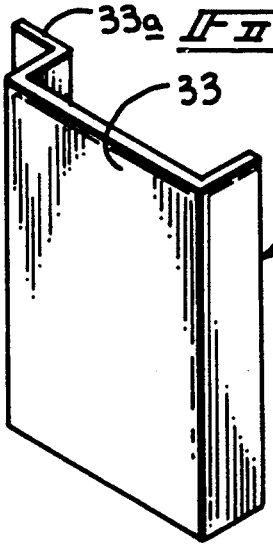
FIG. 12 is an isometric illustration of a window molding cover utilized by the invention.
Figure 13:
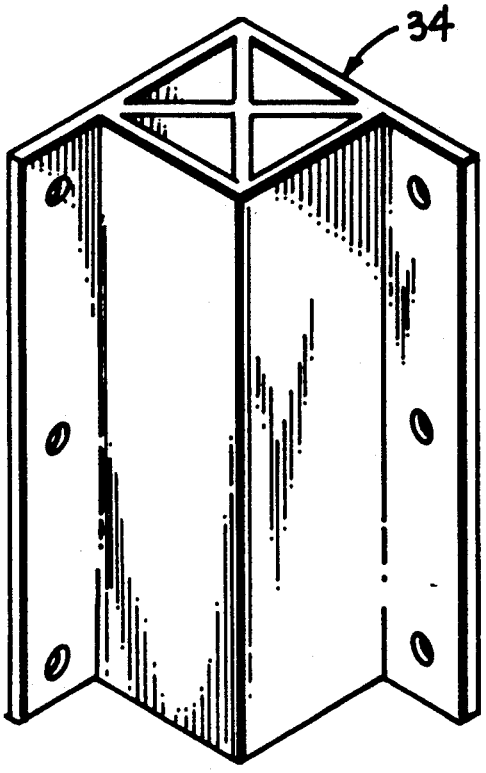
FIG. 13 is an isometric illustration of an inside corner cover utilized by the invention.

The FIGS. 11, 12, and 13 illustrate the use of respective outside corner covers 29, window molding covers 32, and inside corner covers 34. The outside corner cover 29 is formed with first and second plates 30 and 31 joined at a right angle relative to one another, with each plate including a respective first and second plate flange 30*a* and 31*a* to receive fasteners in the mounting of the organization to an outside corner. The window molding cover 32 includes a "U" shaped channel 33 to receive a window molding portion therewithin, including a channel flange 33*a* to enhance its securement to the associated wall structure "W" in use. The inside corner cover 34 is essentially a plurality of flanges integrally and orthogonally mounted relative to one another utilizing an interior corner member of a generally parallelepiped configuration to provide integrity to the organization in use.

Figure 14:
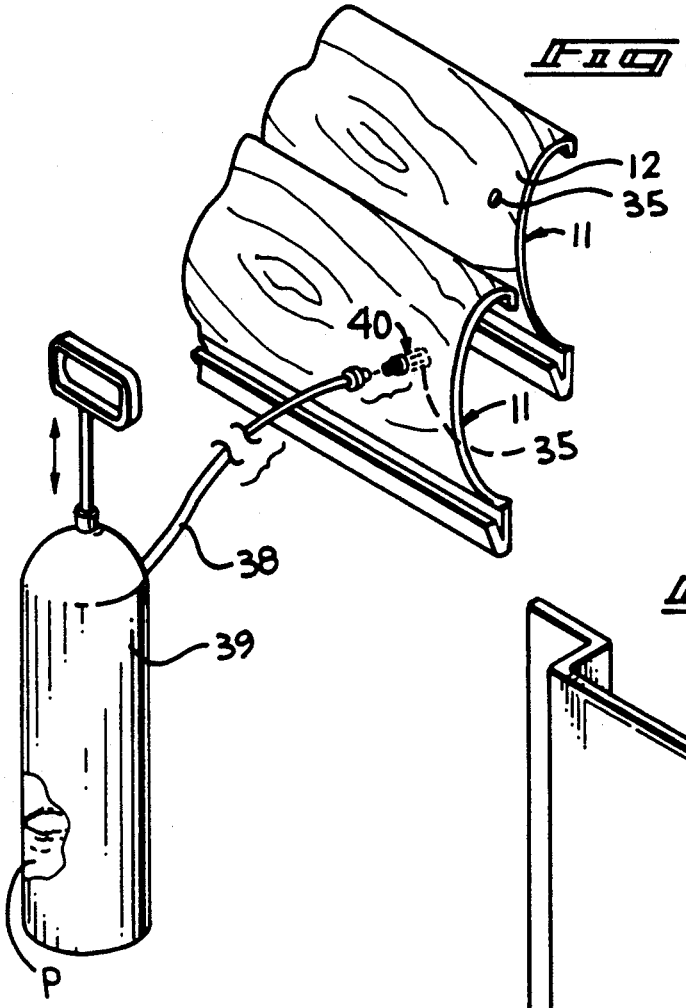
FIG. 14 is an isometric illustration of a modified aspect of the invention.
Figure 15:
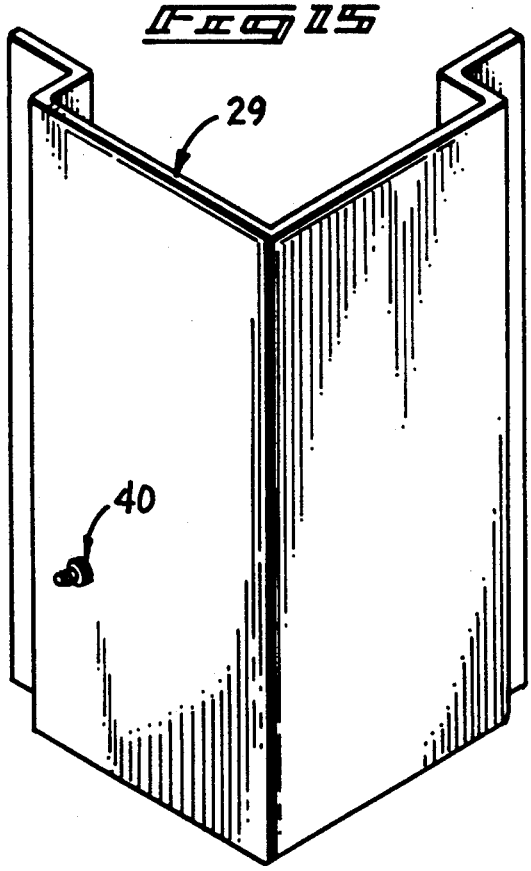
FIG. 15 is an isometric illustration of the outside corner cover member utilizing the connector member to receive a pesticide fumigant directed into the corner cover.
Figure 16:
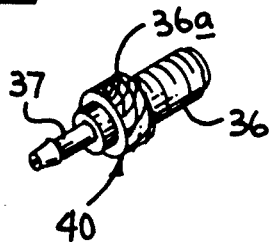
FIG. 16 is an isometric illustration of the connector member utilized by the invention, as illustrated in use in FIG. 14.

FIGS. 14-16 illustrate the apparatus employing a connector member 40 of the type as illustrated in FIG. 16, including an externally threaded conduit tube 36 coaxially aligned and in communication with a tube projection conduit 37 to receive a pesticide conduit 38 to couple a pesticide reservoir 39 that is typically pressurized to permit projection of pesticide within the longitudinal member cavity 24 to accommodate application of pesticide, fungicide, and the like within the structural longitudinal members 11. The use of threaded bores 35 directed through the arcuate convex wall portions 12 provide access for a pesticide applied interiorly of each longitudinal member 11. The pesticide "P", as illustrated in the FIG. 14, may be one of a variety of commercially available pesticide solutions for use exteriorly of a dwelling.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be emcompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A simulation log siding apparatus for mounting to a structural vertical wall surface, wherein the apparatus comprises, at least a plurality of longitudinal members arranged in a parallel interlocking edge-to-edge relationshp, including an upper longitudinal member and a lower longitudinal member, the upper longitudinal member and the lower longitudinal member each including an arcuate convex semi-cylindrical wall portion defining a longitudinal member cavity, wherein the semi-cylindrical wall portion includes an upper end and a lower end, the upper end including an upper planar flange, and the lower end including a lower flange, wherein the upper planar flange and the lower flange are coplanar and are diametrically aligned relative to the semi-cylindrical wall, and the lower flange including a lower flange plate mounted to a lower edge of the lower flange plate coextensive therewith to define a "V" shaped trough between the lower flange and the lower flange plate, wherein the upper planar flange of the lower longitudinal member is received within the "V" shaped trough of the upper longitudinal member, and a starter strip for securement to the wall surface, wherein the starter strip includes a rear starter plate mounted coextensively to a forward starter plate defining a receiving trough, and a plurality of spaced rear openings directed through the rear starter plate and a plurality of forward openings directed through the forward starter plate are aligned relative to one another for reception of fastener structure therethrough, wherein the upper planar flange of the upper longitudinal member is received within the receiving trough, and the lower flange and the lower flange plate are secured together at a lower flange junction, wherein a plurality of apertured securement flanges are fixedly mounted to the lower flange junction, wherein the securement flanges are coplanar with the lower flange and the upper planar flange, and each arcuate convex semi-cylindrical wall includes a threaded bore directed therethrough, and each threaded bore includes a connector member, the connector member including an externally threaded conduit tube threadedly directed into the threaded bore, with the externally threaded conduit tube including a tube projection conduit coaxially aligned with the externally threaded conduit tube, wherein an abutment head formed at an upper terminal end of the externally threaded conduit tube limits projection of the externally threaded conduit tube within the threaded bore, and pesticide conduit is secured to the tube projection and the pesticide conduit in fluid communication with a pressurized pesticide reservoir to direct pesticide through the connector member into the longitudinal member cavity of each longitudinal member.

* * * * *